US010457450B2

(12) United States Patent
Rios

(10) Patent No.: US 10,457,450 B2
(45) Date of Patent: Oct. 29, 2019

(54) INTERGRAL, SINGLE MATERIAL CONTAINER CAP

(71) Applicant: Ramon Tamarit Rios, Valencia Puzol (ES)

(72) Inventor: Ramon Tamarit Rios, Valencia Puzol (ES)

(73) Assignee: DESARROLLOS TAMARIT PLAZA SL, Valencia (ES)

( * ) Notice: Subject to any disclaimer, the term of this patent is extended or adjusted under 35 U.S.C. 154(b) by 0 days.

(21) Appl. No.: 14/733,425

(22) Filed: Jun. 8, 2015

(65) Prior Publication Data

US 2015/0375909 A1 Dec. 31, 2015

Related U.S. Application Data

(63) Continuation of application No. 13/481,227, filed on May 25, 2012, now abandoned, which is a continuation of application No. PCT/ES2012/070354, filed on May 18, 2012.

(30) Foreign Application Priority Data

Aug. 12, 2011 (ES) ..... 2011-31389
Aug. 12, 2011 (ES) ..... 2011-31940

(51) Int. Cl.
*B65D 47/08* (2006.01)
*B65D 47/24* (2006.01)

(52) U.S. Cl.
CPC ..... *B65D 47/0842* (2013.01); *B65D 47/243* (2013.01); *B65D 2205/00* (2013.01)

(58) Field of Classification Search
CPC ..... B65D 47/0838; B65D 47/0809; B65D 47/32; B65D 47/0804; B65D 47/0814; B65D 47/0885; B65D 47/06; B65D 47/0847; B65D 47/0895; B65D 2251/0093; A47G 19/2272; A47G 19/2227; A61J 1/1412
USPC ..... 215/211, 216, 235–236, 259, 260–262, 215/307, 309; 220/202, 203.05–203.07, 220/203.11, 203.13, 203.19, 220/203.27–203.29, 287, 303, 367.1; 222/490, 494, 544–546, 562
See application file for complete search history.

(56) References Cited

U.S. PATENT DOCUMENTS

| | | | |
|---|---|---|---|
| 2,328,382 | A | 8/1943 | Langdon |
| 2,598,002 | A | 5/1952 | Langdon |
| 3,059,816 | A | 10/1962 | Goldstein |
| 3,655,102 | A | 4/1972 | Moran |
| 4,524,805 | A | 6/1985 | Hoffman et al. |
| 4,838,441 | A | 6/1989 | Chernack |

(Continued)

FOREIGN PATENT DOCUMENTS

| | | | |
|---|---|---|---|
| EP | 727531 | A1 | 8/1996 |
| FR | 2 904 610 | A1 | 2/2008 |

(Continued)

*Primary Examiner* — Chun Hoi Cheung
*Assistant Examiner* — Brijesh V. Patel
(74) *Attorney, Agent, or Firm* — Sughrue Mion, PLLC

(57) ABSTRACT

The present invention relates to an single piece integral cap, made from a single material, for consuming a liquid from a container. The cap has at least one hole for the exit of liquid from the container and an inlet for the entrance of air into the container. This air inlet incorporates a check valve that allows for the entrance of air but not the exit of liquid. This check valve is built into the body of the cap.

20 Claims, 10 Drawing Sheets

(56) References Cited

U.S. PATENT DOCUMENTS

| | | | |
|---|---|---|---|
| 4,946,062 | A | 8/1990 | Coy |
| 5,079,013 | A | 1/1992 | Belanger |
| 5,221,017 | A | 6/1993 | Cistone et al. |
| 5,927,566 | A | 7/1999 | Mueller |
| 6,089,411 | A | 7/2000 | Baudin et al. |
| 6,702,137 | B1 | 3/2004 | Kowa et al. |
| RE38,692 | E | 2/2005 | Wong |
| 7,753,234 | B1 | 7/2010 | Heiberger |
| 7,975,883 | B2 | 7/2011 | Laib et al. |
| 2002/0158075 | A1 | 10/2002 | Caldicott et al. |
| 2005/0184075 | A1 | 8/2005 | Belcastro |
| 2006/0071040 | A1 | 4/2006 | Young |
| 2006/0151499 | A1 | 7/2006 | Lieberman et al. |
| 2006/0201955 | A1 | 9/2006 | Stribling et al. |
| 2006/0201976 | A1 | 9/2006 | Bloom et al. |
| 2011/0297698 | A1 | 12/2011 | Chiang et al. |

FOREIGN PATENT DOCUMENTS

| | | | |
|---|---|---|---|
| GB | 2 266 045 | A | 10/1993 |
| WO | 03/101261 | A1 | 12/2003 |

INTERGRAL, SINGLE MATERIAL CONTAINER CAP

CROSS-REFERENCE RELATED APPLICATIONS

This Application is a continuation of U.S. application Ser. No. 13/481,227, filed May 25, 2012, which is a U.S. filing claiming benefit of PCT/ES2012/070354, filed May 18, 2012, which claims priority from Spanish Patent Application Nos. P201131389, filed Aug. 12, 2011, and P201131940, filed Nov. 29, 2011, the contents of all of which are incorporated herein by reference in their entirety.

OBJECT OF THE INVENTION

The present invention relates to a cap with a valve arranged therein for a liquid container, the cap preferably being of the type that is coupled to an opening of the container, such as PET bottles, although it also can be used in other types of containers, such as bottles used by cyclists or athletes for example. Particularly, the cap described in the application is applied to a liquid container and comprises at least one hole for the exit of liquid from the container and at least one hole for the entrance of air into the container, said air inlet comprising a check valve allowing the entrance of air into the container but not the exit of the liquid, said valve being built into the cap thus forming part of the body of the cap, or in other words built into that part.

This invention applies to the sector of closures for liquid containers, and particularly those closures for containers for drinks, mainly water, isotonic drinks, soft drinks and juices, among others.

BACKGROUND OF THE INVENTION

Closure devices for liquid containers incorporating a hole for the exit of liquid from the container and a hole for the entrance of air into the container, such that said entrance of air aids in the exit of the liquid, are known in the state of the art. Examples of said closure devices are used in cups or bottles with a large diameter, used especially by young children and the elderly.

However, said devices are not widely applied to bottles, mainly to bottle caps for mineral water, soft drinks or isotonic drinks mainly due to the size of the cap and particularly to the surface of said cap. The inclusion of a hole for the entrance of air into the mentioned caps would cause the liquid to come out of the bottle both through the liquid outlet and through the air inlet due to the dimensions thereof. This is because the distance between both inlet and outlet is limited by the surface of the cap, making it necessary to arrange the inlet and outlet close to one another. When the surface of the closure device is larger, usually equal to or greater than 2.5 cm in diameter, it allows placing the liquid outlet and the air inlet at points spaced out from one another, so the aforementioned problem is not present or is present to a lesser extent.

The size of said surface also allows incorporating different mechanisms in the closure device to prevent the liquid from coming out through the air inlet. These mechanisms are formed by elements independent from the body of the cap or cover of the container per se, aiding the user or consumer in consuming the liquid. Said closure devices are primarily made up of different bodies or components coupled to one another forming an assembly, which further has different materials with different mechanical characteristics for the sole purpose of achieving the aforementioned objectives, primarily to aid young children or the elderly in consuming a liquid stored in the container. The fact that the closure device is formed by different bodies or elements coupled to one another involves a manufacturing cost increase because the assembly and coupling of different components must be added to the independent manufacture of the different components, sometimes with materials having specific characteristics such as latex or silicone. This means that these closure devices are intended to be reused due to their high cost compared with caps typically used in small volume PET bottles containing liquid for personal consumption and mainly used by children, the elderly and athletes.

Unlike what has been described, the cap object of the present invention is designed for use in preferably single-use mass consumption products, mainly such as 0, 25 l, 0.33 l, 0.5 l, 0.75 l and up to 2.5 l PET recipients and normally used for mineral water, soft drinks or isotonic drinks. However, this cap is particularly applied in small volume recipients, mainly up to 0.75 l, because they are normally used by users to drink directly from the recipient, and particularly children and athletes.

The caps used today in the aforementioned type of bottles for mineral water, soft drinks and isotonic drinks only have one small hole for the exit of the liquid, so the consumer needs to suck to extract the liquid or compress the recipient or container if the material thereof allows this to directly drink the stream coming out of the liquid outlet. If the consumer sucks, problems derived from said suction, such as the need to stop sucking to take a breath and be able to continue drinking and deformation of the container due to collapse, being creased and/or crushed indiscriminately while sucking, causing a change in the shape of the container, especially when it is made of PET, making it difficult to hold, will occur. These problems are worsened if the consumers are young children, convalescents or the elderly who need to stop to take a breath, running the risk of drinking a lot of liquid since they cannot control the suction exerted with the subsequent risk of choking. A suction cup effect that is annoying for the consumer is created in caps of the state of the art when drinking stops.

By means of the present invention, it is possible to use in recipients or containers of the state of the art caps having the same cost or a cost very similar to that used today having a single outlet for bottles with the aforementioned capacity, but incorporating an added function, which is allowing consuming the liquid without the problems of caps currently used and formed by a single hole.

In summary, in the state of the art, no closure device or cap for bottles or containers is known to have a small entrance surface, usually at least 2.5 cm in diameter, incorporating on the surface of the same body of the cap or closure device a hole for the exit of the liquid and a hole for the entrance of air with a valve controlling the entrance of air into the container and preventing the exit of the liquid contained therein, or check valve, said valve being built into the body of the cap or closure device forming a single body or part made from the same single material, i.e., said valve is part of the same part as the cap with its outlet.

In summary, the caps of the state of the art incorporating or describing check valves are made with several bodies in the sense that they are made up of several elements coupled to one another, the valve being partially made from a resilient and/or flexible material, usually latex or silicone. These materials prevent manufacturing a cap with sufficient rigidity for being coupled to a recipient or container by means of threading for example, not even by using simple and highly productive manufacturing processes that allow obtaining a product with a cost that is very similar or identical to that used today in the aforementioned recipients, i.e., with a cost similar to caps with a single liquid outlet.

DESCRIPTION OF THE INVENTION

The object of the present invention is therefore a cap formed by a single body or part with a top surface and a perimetric side wall which can be fitted on an opening of a liquid container comprising at least one hole, which is preferably always open, for the exit of liquid from the container and at least one hole for the entrance of air into the container, the cap having coupling means for coupling to said container which are preferably located in the perimetric side wall of the cap, and a valve for the entrance of air located in the air inlet, allowing the entrance of air into the container but not the exit of the liquid, such that both said coupling means and said valve are built into the body of the cap forming a single body or part made from the same material. Said material is preferably a semi-rigid material with little or no resiliency in the solid state or use state. Said liquid can be any liquid which is stored in a container for being consumed preferably by sucking directly on the recipient or container through the cap or closure device, for example, water, soft drinks, isotonic drinks or even juices. The liquid can also be consumed when pressing on the recipient such that a stream of liquid comes out through the outlet, so the consumer could drink the stream without coming into contact with the cap.

The valve of the cap is an air check or control valve allowing the entrance of air when sucking the liquid contained inside the recipient or container but preventing the exit of the liquid when the liquid outlet is not sucked on, thus allowing the exit of the liquid only through the hole intended for such purpose. In other words, when the user sucks through the liquid outlet to drink, the valve opens allowing the entrance of air into the container, thereby aiding in drinking the liquid. It is also important to stress again that said check valve is built into or forms part of the body or part of the cap, therefore preferably being made from the same material as the body of the cap, a plastic, preferably rigid or semi-rigid polyethylene, with high strength and low or nil resiliency, primarily in comparison with latex or silicone type materials, which do show considerable resiliency.

The cap object of the invention allows a stream of liquid to come out through the liquid outlet when compressing the recipient, the valve remaining closed, preventing both the exit of liquid due to the pressure exerted by the liquid on the valve and the entrance of air into the recipient.

The cap is manufactured by means of a one-step injection process using a single mold. It is also possible for the body of the cap and the valve to be made of two different materials, or at least two materials but with similar properties, and particularly similar rigidity, which form a single body with the valve built into it.

The cap is fitted on the container through the coupling means which are preferably a threading or pressure elements and they are preferably arranged on the inner surface of the perimetric or side wall of the cap, the wall located in the perimeter and perpendicular to the surface of the cap in which the liquid outlet and air inlet are located.

Likewise the cap preferably incorporates a cover or top for closing the inlet and outlet, mainly the liquid outlet because the air inlet is closed by default. Said cover can be integral with the cap or independent from it.

Due to the presence of said valve in the air inlet, the cap object of the invention prevents the liquid from coming out through said hole when the user is not drinking from the container. Since the check or control valve controlling the entrance of air into the recipient or container performs both functions, it is kept closed when the user is not drinking through the liquid outlet, however when the user drinks through the outlet, the suction generated will cause the valve to open, therefore allowing the entrance of air into the container through it and aiding the liquid to exit through the liquid outlet. When the user stops sucking, the valve closes, preventing both the entrance of air and the exit of liquid. Therefore, when the consumer drinks he/she can control the desired flow of liquid by controlling the suction and the entrance of air into the container, i.e., greater flow is achieved with greater suction and vice versa.

Said check or control valve is preferably made of the same rigid or semi-rigid material with low or nil resiliency in the solid state as the rest of the body, and it is formed by a tubular body, not necessarily cylindrical, with two ends such that a first end is located in contact with the bottom surface of the cap, with the walls of the body or tubular conduit surrounding the air inlet on the bottom side of the cap, and the second end, which is free and opposite the first end, has walls in contact with one another closing the tubular body, such that a cross-section of the body of the valve in the closed position has an approximately triangular shape. Therefore when the cap is fitted on container, said tubular body is inserted therein, such that in the rest position the tubular body integral with the bottom surface of the cap is closed at its free end and in the working position when someone is drinking, said free end opens, allowing the circulation of air into the container, having an approximately rectangular cross-section.

Depending on the dimensions of the surface of the cap, said surface could include one or more holes for the exit of the liquid, as well as one or more holes for the entrance of the air. It should be pointed out that due to the small dimensions of the available surface in the caps, the possibilities of improving the exit of the liquid and of reducing the turbulence of the liquid during said exit are limited, however, by means of the present invention both objectives are achieved in comparison with the caps known in the state of the art which do not propose solutions to the mentioned problems.

The air inlet can have any geometric configuration, such as for example, the form of a groove, of a circle, etc., so the tubular body can also have any geometric configuration, provided that the free end of the tubular body in the rest position is closed. The first end of the tubular conduit in contact with the surface of the cap can also coincide with the perimeter of the air inlet, such that the first end of the tubular body has the same shape as the air inlet, said tubular body being an extension of the cap into the container. The air inlet is preferably a groove surrounded by the tubular body which is not cylindrical in this case.

As mentioned, the tubular body is built into the cap, forming a single part or body with the cap after the injection of the part or body of the cap during the same injection manufacturing process. The second end or free end of the tubular conduit, opposite the end integral with the surface of the cap, has a cut therein allowing its opening, said cut preferably made by a cutting element during the injection process.

By means of the configuration of the cap with the check valve, the user wanting to drink the liquid from the container through the liquid outlet will suck the liquid through the outlet. The valve allows the entrance of air into the container because said suction created by the user causes a pressure drop inside the container that forces the walls of the second free end of the tubular body to separate, thereby allowing the entrance of air into the container and therefore aiding the liquid in flowing through the liquid outlet without deforming said container and with a controlled suction force. When the user stops sucking, the walls of the second end or free end return in contact with one another, thereby closing the conduit of the tubular body and preventing both the entrance of air and the exit of liquid through the air inlet. By means of this valve, the consumer can control the desired flow of water by controlling the suction and the entrance of air into the container, i.e., greater flow is achieved with greater suction and vice versa. Also due to the check valve, the cap object of the present invention allows the user to drink without needing to stop the consumption to take a breath and continue drinking, as occurs in caps with one liquid outlet currently used in PET containers, PET recipients or preferably PET bottles.

Furthermore, if the consumer presses the container or recipient from the outside, compressing the bottle, a stronger sealing of the valve will occur when the compressed liquid exerts pressure on the walls of the second end or free end, preventing the exit of the liquid through it and assuring the tightness. The working of the cap is therefore identical to that of a cap with a single hole that enables directly drinking the stream obtained by pressing the walls of the container without needing the lips of the consumer to come into contact with the cap.

While the cap is made up of a single part or body made from a single material, there can be additional complements for the cap such as plugs located in the outlet itself, independent of the body of the cap. Such caps with a plug are particularly applied in recipients or bottles for isotonic drinks, commonly used by athletes, because they do not comprise a cover or top integral with the cap in order to aid in consuming the liquid by moving the plug with the mouth, without needing to use the hands. The consumer could then drink the liquid by sucking or the user could drink a stream.

In the case of a cap with a movable plug, the cap object of the present invention has the features described above, i.e., an air inlet with a valve and a liquid outlet forming a single body of the cap, but with a different structure mainly affecting the liquid outlet to allow the arrangement of the movable plug therein.

Particularly, the liquid outlet is surrounded by a coaxial wall located in the top part of the surface of the cap and has a guiding element with the same section as the liquid outlet, preferably coaxial cylindrical, located inside it and extending from the bottom part of the surface of the cap to above the coaxial wall located outside the outlet, said guiding element being secured to the bottom part of the surface of the cap by means of ribs. The guiding element thereby remains centered with respect to the liquid outlet as a result of said ribs, there preferably being three equidistantly separated from one another. Said guiding element is plugged by its outer end. Like the valve described above and also built into the cap, this structure forms the body or part of the cap as it is built per se into the body of the cap and is made from the same material as it by means of an injection process.

The plug of the cap is located on said cylindrical element, said plug of the cap having a body with the same section as the liquid outlet, preferably a hollow cylindrical body open at its two ends, wherein the guiding element of the cap is inserted, the plug being able to move along said guiding element. The movement of the plug causes, in a first position, the outer end of the guiding element to press against the outer opening of the body of the plug, so the cap would be closed, and in a second position, the cap would be open because the ends of the guiding element of the cap and the body of the plug are not in contact. When the cap is open, the liquid circulates between the outer surface of the guiding element of the cap and the inner surface of the body of the plug, the liquid thus coming out through the outer end of the body of the plug. The outer surface of the body of the plug is in contact with the inner surface of the wall determining the outlet of the cap and coaxial to said outlet, to the guiding body of the cap and to the body of the plug. Said body of the plug can have stops or elements limiting its movement to prevent it from coming out of its position between the guiding element of the cap and in the liquid outlet.

The cylindrical body of the plug can incorporate side, vertical and horizontal outer surfaces at its base, preferably curved surfaces, which have a dual function. On one hand they accommodate the lips on said vertical outer surfaces when drinking, and on the other they prevent said lips from being able to plug the air inlet, and therefore the valve, when accommodated on the horizontal outer surfaces at the base, which could entail improper working of the cap.

The top surface of the cap can be slightly recessed with respect to the perimetric wall such that the horizontal outer surfaces of the plug are inserted therein assuring the closure of both the air inlet valve and of the liquid outlet without projecting above the body of the cap.

DESCRIPTION OF THE DRAWINGS

To complement the description that is being made for the object of the invention and to aid in better understanding the features distinguishing it, a set of the following drawings is attached to the present specification which depict the following in an illustrative and non-limiting manner.

PREFERRED EMBODIMENTS OF THE INVENTION

Figure 1:
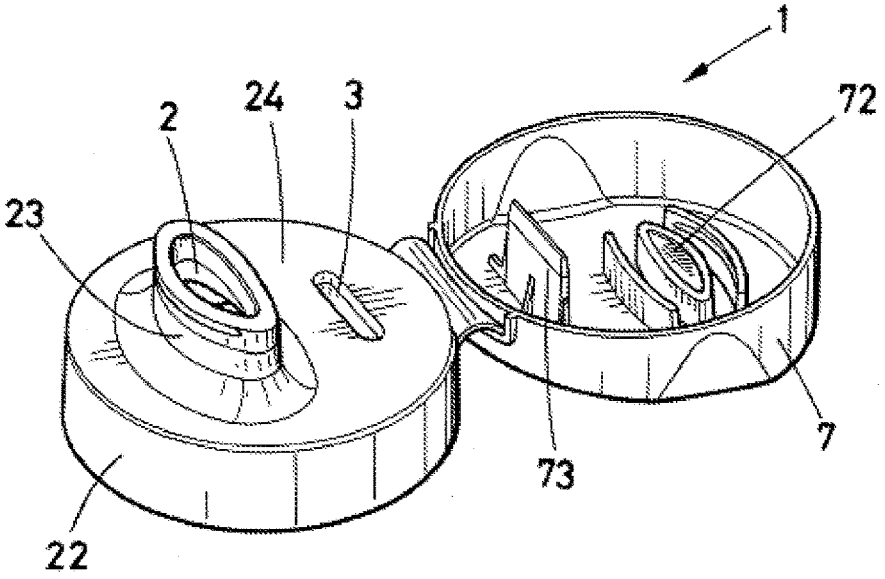
FIG. 1 shows a top perspective view of a first embodiment of a cap with a cover object of the present invention.
Figure 2:
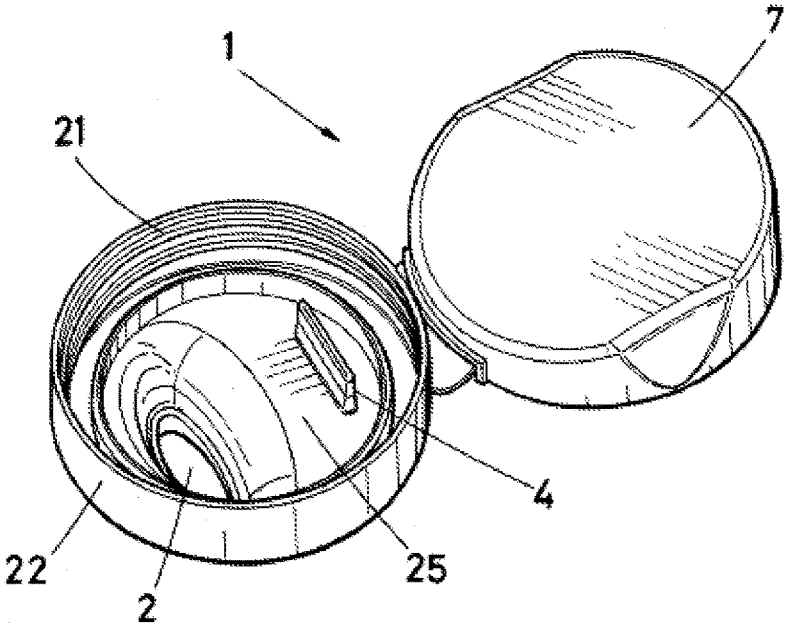
FIG. 2 shows a bottom perspective view of the cap of FIG. 1.
Figure 3:
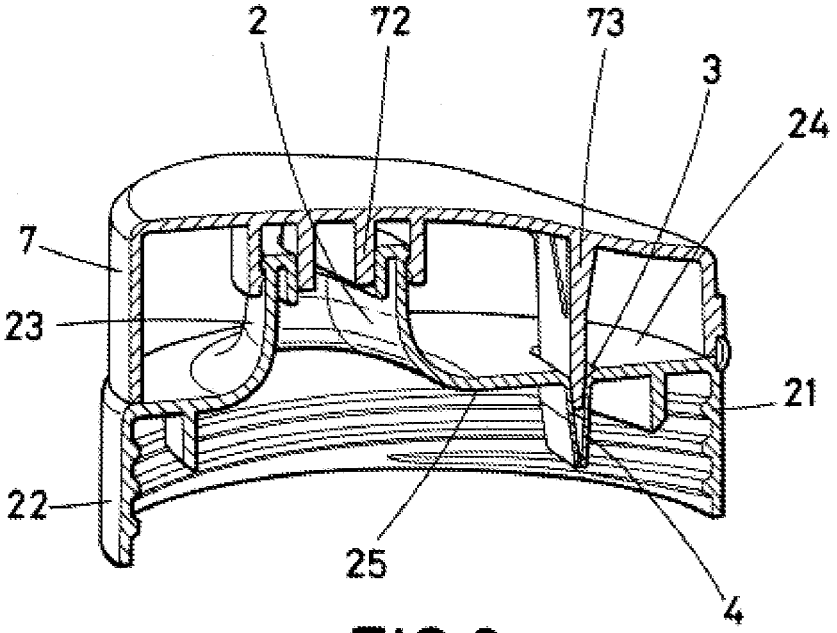
FIG. 3 shows a perspective section of the cap of the preceding figures.

In view of the mentioned drawings and according to the numbers used, a preferred embodiment of the invention can be seen therein, comprising the parts and elements described in detail below.

FIGS. 1 to 7 show a first embodiment of a cap object of the present invention. As can be seen in said figures, the cap 1 object of the present application incorporates a liquid outlet 2, which is preferably always open, placed in a nozzle 23, and an air inlet 3 comprising a check valve or control valve 4 for controlling the entrance of air into the recipient. The cap has a top surface 24 and a perimetric side wall 22. The liquid outlet 2 and the air inlet 3 are located on said top surface 24. The check valve is located in the bottom part 25 of said surface. In this example, the diameter of the cap is approximately 3.2 cm, a typical diameter in 0.33 and 0.5 liter recipients containing water, and the distance between the axis of symmetry of the liquid outlet and the axis of symmetry of the air inlet is approximately 1.3 cm, said distance being able to range between 1 and 1.5 cm.

The cap 1 has as fixing means for fixing to a container or bottle 6 threading 21 in the perimetric wall 22 of the cap 1 for being fitted on the neck of the bottle 6 as well as a top or cover 7 integral with said cap 1.

The cap 1 allows consuming the drink from inside the bottle 6 comfortably and without the risk of the liquid coming out through the air inlet 3. A consumer will suck on the spout or nozzle 23 of the liquid outlet 2, creating a pressure drop inside the bottle 6 which will cause the check valve 4 to open and air to therefore enter the bottle 6. When no pressure drop is generated because there is no suction, the valve 4 closes and remains in this situation.

Said valve 4 forms part of the body or part of the cap 1 as it is made from the same material as said cap and in the same manufacturing process, such that the different components of the cap form a single part or body obtained by means of a one-step injection process. The material of the cap is preferably a rigid or semi-rigid plastic in solid state, preferably polyethylene, and although flexible it is not resilient in said state. In any case, a cap with two or more materials, at least one for the body of the cap and another for the valve, would also be possible, being able to be manufactured in a single injection or in two provided that they allow manufacturing the cap such that the components form a single body or part.

Figure 4:
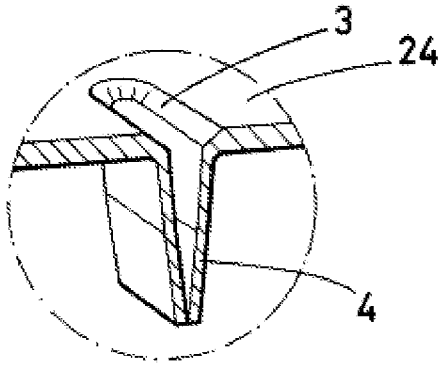
FIG. 4 shows a detail of a valve of a cap according to the present invention.
Figure 5:
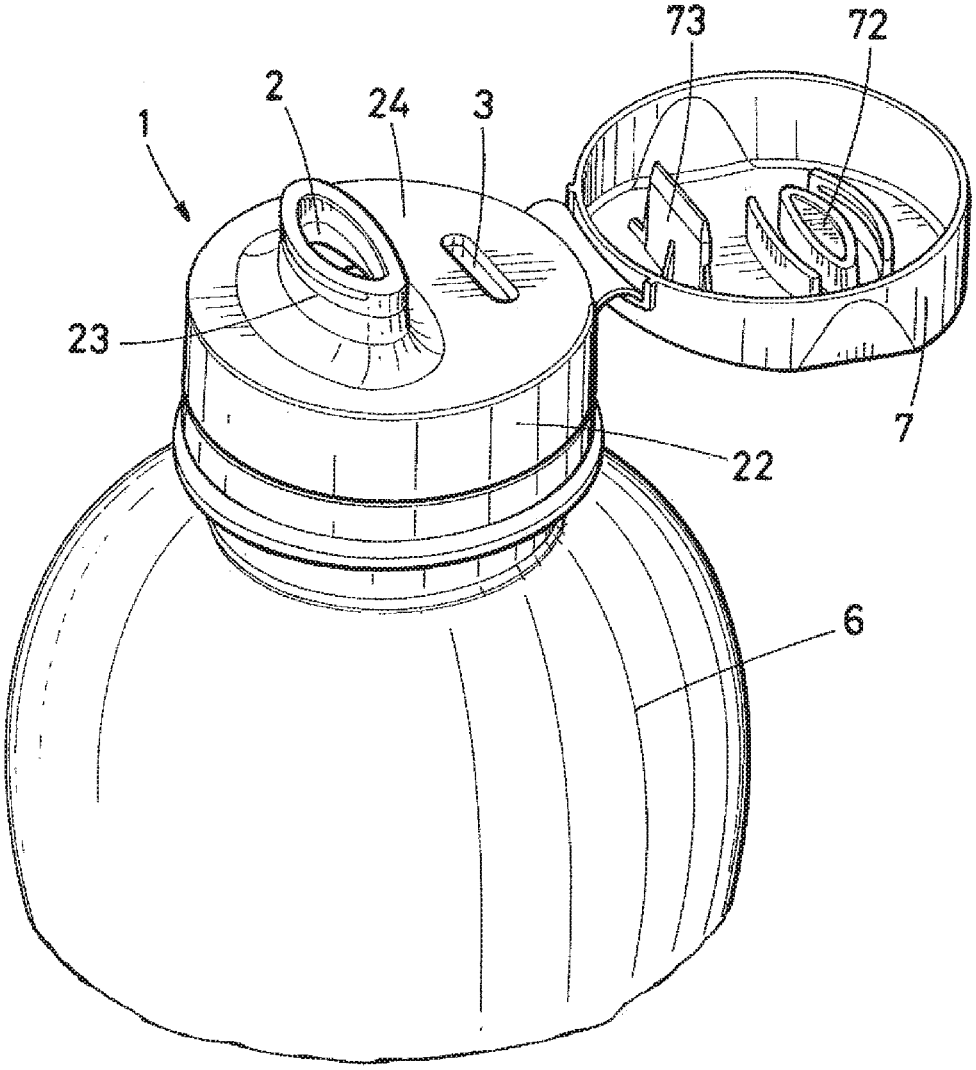
FIG. 5 shows a first embodiment of a cap object of the invention on a bottle.
Figure 6:
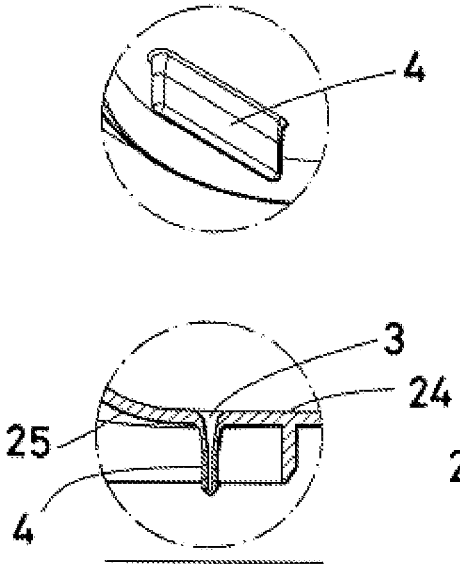
FIG. 6 shows an embodiment of a valve.
Figure 7:
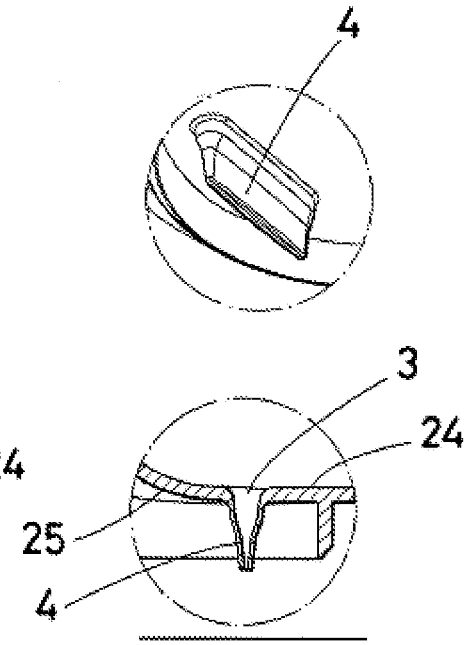
FIG. 7 shows an alternative embodiment of a valve from the preceding figure.
Figure 8:
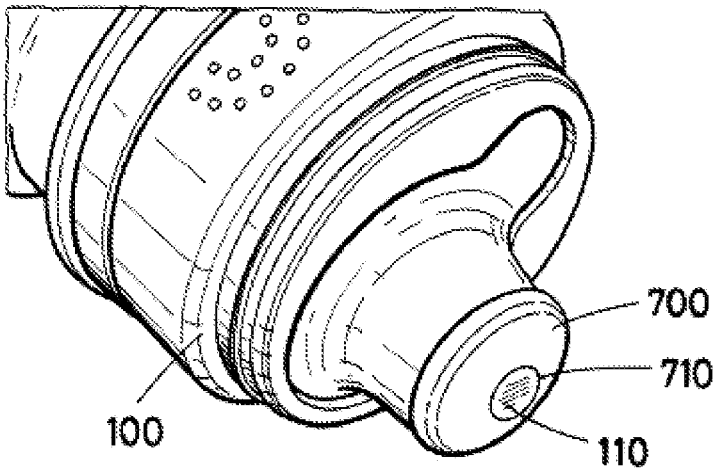
FIG. 8 shows a second embodiment of a closed cap object of the invention with a plug.

The check valve 4 shown in FIG. 4 consists of a tubular body forming part of the body of the cap 1 per se, with the walls of the first end of said tubular body surrounding the air inlet 3, and the walls of the second end of said body, in contact with one another closing the conduit of the tubular body.

The cap object of the present invention is preferably located in a bottle or container 6 by means of threading 21 for fitting on the neck of the bottle as well as a top or cover 7 integral with said cap. The top 7 can internally incorporate projections 72 adapting to the liquid outlet or outlets 2, as well as projections 73 adapting to the air inlet or inlets 3.

As described above, the cap 1 allows consuming the drink from inside the bottle comfortably and without the risk of the liquid coming out of the bottle 6 through the air inlet 3. When a consumer or user wishes to drink directly from the bottle 6, he/she could either suck on it or drink a stream. If the consumer sucks on the liquid outlet 2, or through the nozzle or spout 23, a pressure drop is created inside the bottle that causes the check valve 4 to open when forcing the walls of the second end of the tubular body of the valve 4 to separate, thereby allowing the entrance of air into the bottle by going through the inlet 3 and the conduit of the tubular body to reach the inside of the bottle 6. The greater the suction, the greater will be the opening of the valve 4 since the separation of the walls of the second end of the tubular body is greater, and therefore the exit of liquid will be greater. The opposite also occurs. When no pressure drop is generated because there is no suction, the valve 4 closes when the walls of the second end come together.

If the consumer wants to drink a stream, i.e., directly from the stream coming out through the liquid outlet 2 of the cap 1, if the bottle 6 allows doing so, the consumer can compress said bottle 6 on the outside such that the walls of the second end of the valve are sealed by the compressing action of the liquid contained therein, forcing the liquid to exit through the liquid outlet 2, as if the cap 1 only had a single hole on its surface.

Said tubular body forms part of the body of the cap 1, forming one and the same single part, such that the tubular body is an extension into the container or bottle 6 of the air inlet 3, and in this case it has the form of a groove, although it could also have other forms, such as a circular form.

The cap 1 and the check valve 4 object of the present invention are preferably applied in bottles for water or soft drinks, the valve 4 being incorporated in the cap 1. Said cap can also be used for consuming isotonic drinks.

The material used for manufacturing the cap object of the present invention is preferably a low density polyethylene or polypropylene resin with a density between 0.85 and 1.2 gr/cm3, more preferably between 0.9 and 0.95 g/cm3. Some of the materials that can be used are PP575P or PP412MN40 by SABIC, PR280P1M by ISPLEN (REPSOL) or lDPE LD 104BR by ExxonMobil.

FIGS. 8 to 14 show a second embodiment of a cap according to the present invention, said cap 100 particularly applied to bottles containing isotonic drinks for being used by people practicing a sport since they allow drinking the content of the bottle without needing to remove a cover or top, the plug 700 incorporated in the cap 100 for opening or closing the cap 100 is moved simply using the mouth. Said cap has a liquid outlet with a configuration different from that described and a valve 310 identical to that described above in the first embodiment. In this example, the diameter of the cap is approximately 3.9 cm, a typical diameter in 0.5 liter recipients containing isotonic drinks, and the distance between the axis of symmetry of the liquid outlet and the axis of symmetry of the air inlet is approximately 1.4 cm, said distance being able to range between 1 and 1.7 cm, approximately.

In this embodiment, the liquid outlet is cylindrical and is surrounded by a coaxial wall 130 demarcating it, located in the top part of the surface of the cap 120, and it has a coaxial cylindrical guiding element 110 located inside the outlet and extending from the bottom part of the surface of the cap 120 to above the coaxial wall 130 located outside the outlet. Said cylindrical guiding element 110 is kept in that position, coaxial to the coaxial wall 130 and preferably centered with respect to the outlet, due to the arrangement of preferably three equidistant ribs 140. The ribs 140 extend from the bottom part of the surface of the cap 120 to the bottom end of the cylindrical guiding element 110 of the cap. The cylindrical guiding element 110 is plugged on its outer top end. This structure, together with the valve 310 communicating with the air inlet 300, forms the body or part of the cap since it is built into the body of the cap per se and is made from the same material by means of the same injection process.

Figure 9:
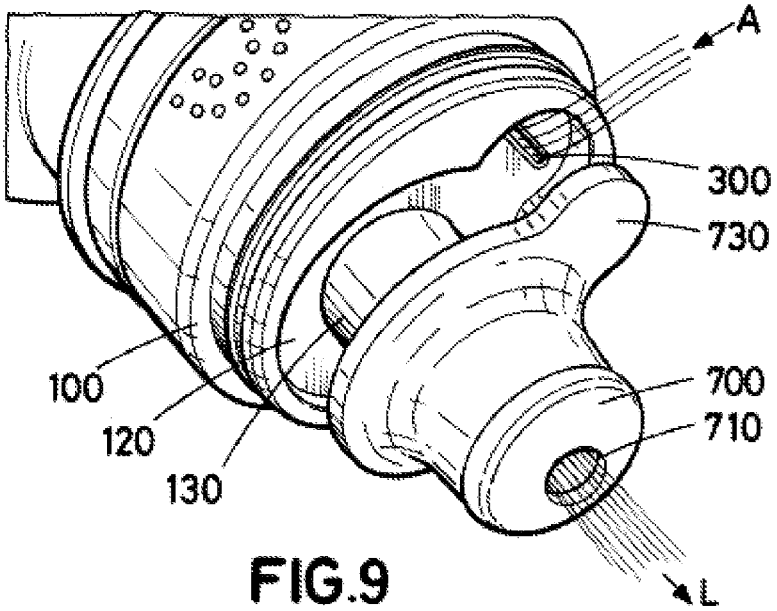
FIG. 9 shows the cap of FIG. 8 open, wherein the flows of incoming air and of exiting liquid are observed.
Figure 10:
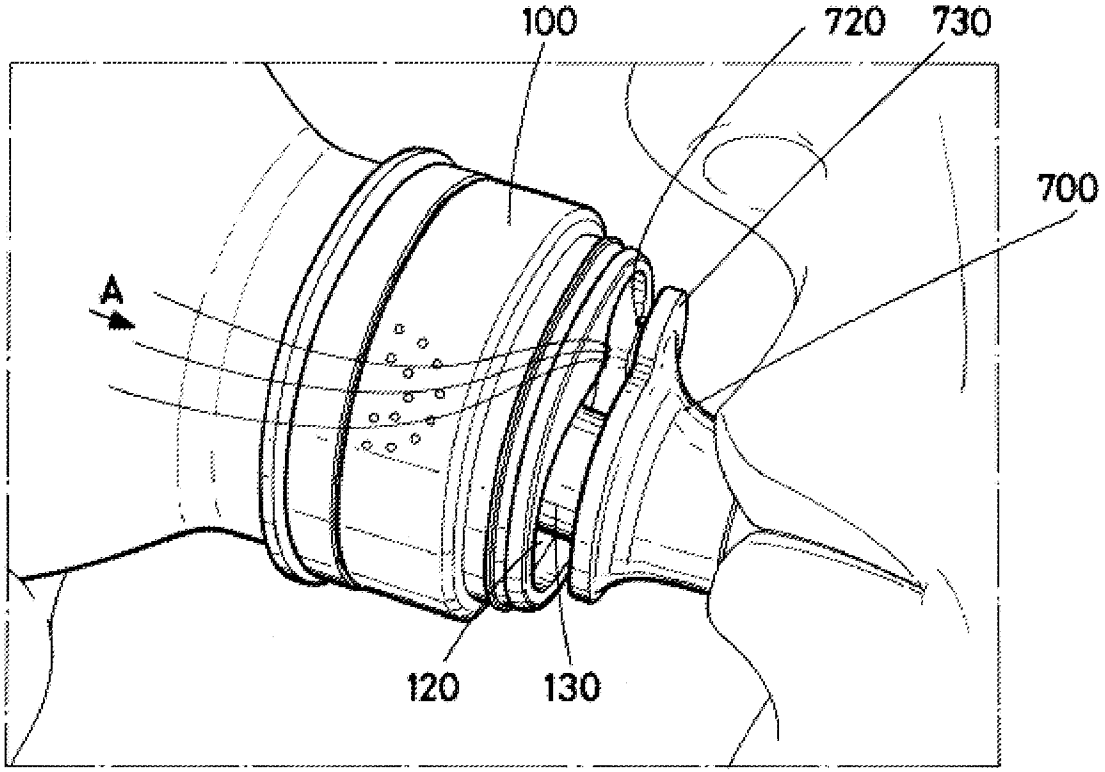
FIG. 10 shows the cap of FIG. 9 being used by a user.
Figure 11:
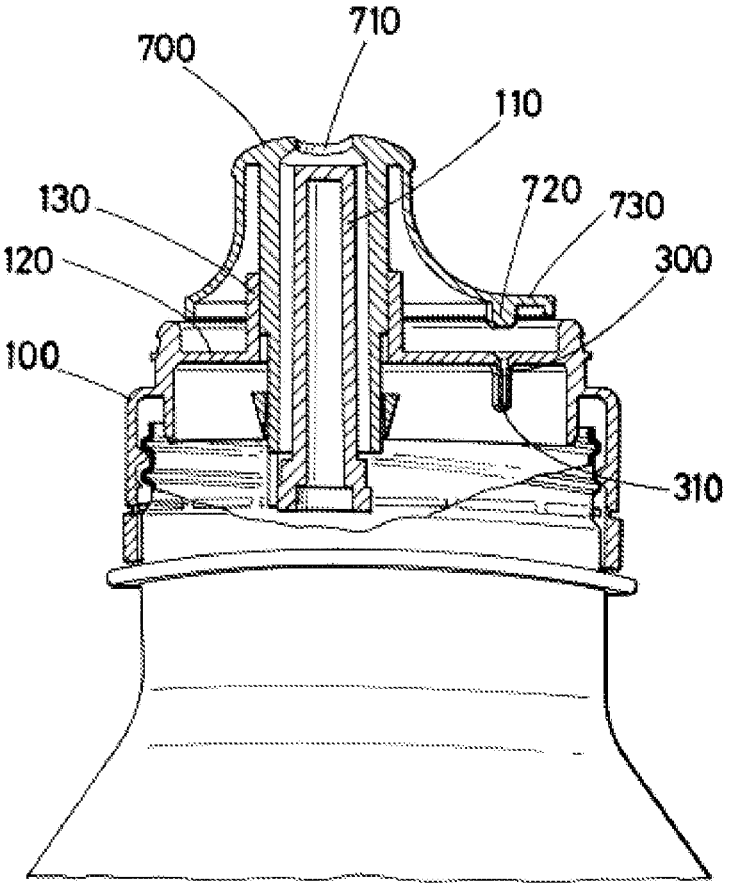
FIG. 11 shows a section of the partially open cap with a plug.
Figure 12:
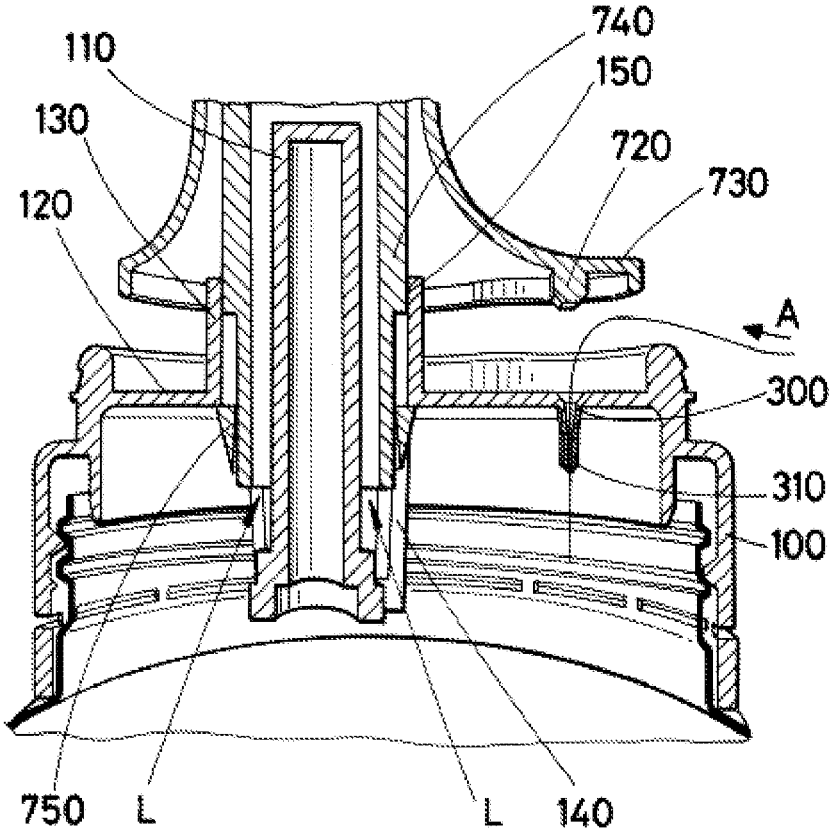
FIG. 12 shows a section of the completely open cap with a plug showing the flows of air and liquid.
Figure 13:
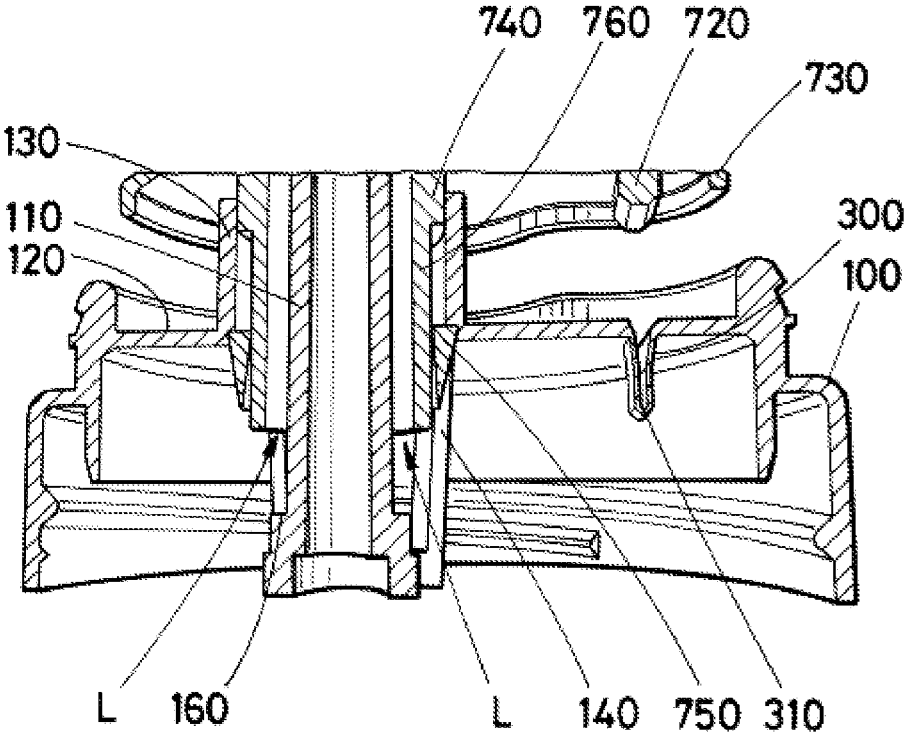
FIG. 13 shows a detail of the section of FIG. 12.
Figure 14:
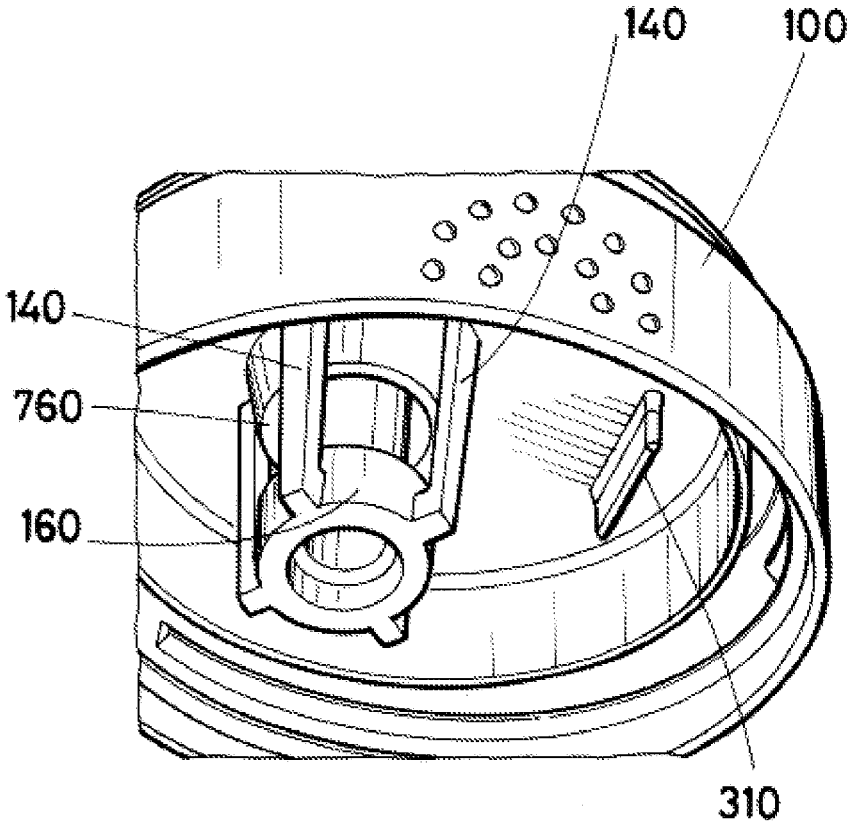
FIG. 14 shows a bottom view of a cap with a plug.

The plug 700 of the cap 100 is located on the cylindrical guiding element 110 serving as a guide for moving the plug 700 along the guiding element 110, and is formed by a hollow cylindrical body 740 open at its two ends, wherein the cylindrical guiding element 110 of the cap 100 is inserted, the plug 700 being able to move along said cylindrical guiding element 110 between two limit positions with other intermediate positions. The movement of the plug 700 causes, in one of the two limit positions (FIG. 8), the outer end of the cylindrical guiding element 110 to press against the outer opening 710 of the cylindrical body 740 of the plug 700, such that the cap 100 would be closed in this position. In the other limit position in which the cap 100 is completely open, the outer opening 710 of the plug 700 is elevated with respect to the outer or top end of the cylindrical guiding element 110 (FIG. 9).

When the cap 100 is open, the liquid L circulates between the outer surface of the cylindrical guiding element 110 of the cap 100 and the inner surface of the cylindrical body 740, 760 of the plug 700, the liquid L thus coming out through the opening 710 at the outer end of the cylindrical body 740 of the plug 700. The outer surface of the cylindrical body 740 of the plug 700 is in contact with the inner surface of the wall of the cap 130 coaxial to the outlet. Said plug 700 can have stops 750 for limiting its movement and preventing the plug 700 itself from coming out of its position.

When the cap 100 is closed, the bottom end 760 of the cylindrical body 740 of the plug 700 rests on a projection 160 arranged at the inner end of the cylindrical guiding element 110.

The plug 700 incorporates a vertical surface externally surrounding the cylindrical body 740, preferably a curved surface, for the purpose of accommodating the lips on said surface. A curved horizontal surface also extends from the base of the plug 700 for, in addition to allowing support for the lips, also for preventing lips from plugging the air inlet 300, and therefore the valve 310, preventing the air A from entering the bottle.

The top surface 120 of the cap can be slightly recessed with respect to the perimetric wall such that the ends of the surface of the plug 700 are introduced in said recess.

The working of this cap 100 is similar in its conception to that described above, with the particularity of having the plug 700. The user uses his/her mouth to move the plug 700 outwards such that the liquid L can circular between the cylindrical body 740 of the plug and the cylindrical element 110 of the cap 100. By sucking on the outlet 710 of the plug 700, the valve 310 opens thereby allowing the entrance of air A into the bottle. Like in the embodiment described above, the consumer, who is usually an athlete, can consume the liquid either by sucking or by drinking the stream.

The invention claimed is:

1. A cap, made from a single material, having a top surface, a cover adapted to fit the top surface, and a perimetric side wall configured to be fitted on an opening of a liquid container, with at least one liquid outlet for the exit of liquid from the liquid container and at least one air inlet, flush with the top surface of the cap, for the entrance of air into the container, comprising a check valve configured to allow the entrance of air into the liquid container, and prevent the exit of the liquid from the liquid container; said check valve built into the cap and protruding inwardly from an inside of the top surface of the cap;

said check valve further comprising a tubular body with two ends, such that a first end is located in the at least one air inlet, and the second end opposite the first comprises contacting walls configured to close the tubular body when at rest; said contacting walls further configured to separate and open the tubular body when said check valve in use or when vacuum is created inside the container;

the perimetric side wall containing threads configured to screw the cap to the opening of the liquid container; wherein the cover, the check valve, the perimetric side wall, and the threads are an integral one-piece construction.

2. The cap according to claim 1 further comprising coupling means for coupling said cap to said container; said coupling means built into the cap so as to form a single body.

3. The cap according to claim 2, characterized in that said coupling means are a threading on the perimetric wall of the cap for fitting said cap on the container.

4. The cap according to claim 1, characterized in that said check valve comprises a tubular body with two ends, and wherein the tubular body extends into the container.

5. The cap according to claim 1, characterized in that the cap and the check valve are made of a substantially identical non-resilient rigid material.

6. The cap according to claim 1, characterized in that the non-resilient rigid material is made of a plastic material such as polyethylene or polypropylene.

7. The cap according to claim 1, characterized in that the non-resilient rigid material is manufactured by means of a single injection.

8. The cap according to claim 1, wherein the cover with internal projections is configured for plugging the at least one liquid outlet and the at least one air inlet.

9. The cap according to claim 1, characterized in that the at least one liquid outlet is open.

10. The cap according to claim 1, wherein the check valve is configured to self-seal mechanically.

11. The cap according to claim 1, wherein the check valve comprises two flaps that are biased to seal together.

12. The cap according to claim 11, wherein each of the two flaps are elongated.

13. The cap according to claim 11, wherein the two flaps and the cap are integral and constructed from one-piece.

14. The cap according to claim 1, wherein the check valve is formed by two flaps that extend from an inside of the top surface of the cap and an opening in the top surface of the cap.

15. The cap according to claim 14, wherein the opening is a slit.

16. The cap according to claim 1, wherein the check valve is configured to unseal due to a drop in pressure on an inside of the cap.

17. The cap according to claim 1, wherein the integral one-piece construction is made from a single material.

18. The cap according to claim 17, wherein said single material is not latex or silicone.

19. A cap according to claim 1, wherein said check valve has a length between the two ends and an opening on the top surface of the cap having a width; said length between the two ends of the check valve is greater than the width of the opening of the check valve.

20. A cap according to claim 1, wherein said check valve has an opening on the top surface of the cap; said opening have a width and a length, and wherein the length of said opening is greater than the width of the opening.

* * * * *